US006932013B1

(12) United States Patent
Shen et al.

(10) Patent No.: US 6,932,013 B1
(45) Date of Patent: Aug. 23, 2005

(54) MANEUVERING OF SUBMERGED WATERJET PROPELLED SEA CRAFT

(75) Inventors: Young T. Shen, Potomac, MD (US); Charles M. Dai, Potomac, MD (US); Bruce D. Cox, Rockville, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 3 days.

(21) Appl. No.: 10/781,957

(22) Filed: Feb. 20, 2004

(51) Int. Cl.[7] ..... B63H 25/46
(52) U.S. Cl. ..... 114/151; 114/330
(58) Field of Search ..... 114/151, 330

(56) References Cited

U.S. PATENT DOCUMENTS 3,122,121 A * 2/1964 Krauth ..... 440/40
4,138,963 A * 2/1979 Thompson ..... 440/40
6,146,219 A * 11/2000 Blanchard ..... 440/40
6,171,159 B1 1/2001 Shen et al.

* cited by examiner

*Primary Examiner*—Jesus D. Sotelo
(74) *Attorney, Agent, or Firm*—Jacob Shuster

(57) ABSTRACT

The stern hull portion of a sea craft through which main exit flow channels extend to projecting jet propulsion nozzles, is provided with facilities for controlled maneuvering of the sea craft, including steering, stopping, negative thrust backing and docking without substantial hydrodynamic loading and with facilitated installation. Such maneuvering control facilities include a secondary flow channel extending from each of the main exit flow channels having two angularly related subchannel branches for pressurized water outflow through gated openings in the hull from which propulsion jets emerge under maneuvering control. Either control of a subchannel diverting flapper, or by use of selective closure gates and a flow diverting flap within the main exit flow channel, maneuvering may be effected in response to inflow through inlet openings in the hull of water that is pressurized before supply to the main exit flow channels.

11 Claims, 7 Drawing Sheets

MANEUVERING OF SUBMERGED WATERJET PROPELLED SEA CRAFT

STATEMENT OF GOVERNMENT INTEREST

The invention described herein may be manufactured and used by or for the Government of the United States of America for governmental purposes without the payment of any royalties thereon or therefore.

The present invention relates to the maneuvering of sea craft having water jet propulsors.

BACKGROUND OF THE INVENTION

Water jet propulsion of marine vessel hulls as compared to screw propeller systems are more flexible in usage, involve less mechanical equipment for hull installation and provide for improved maneuverability of the ship being propelled. Conventional maneuvering systems for water jet propulsors include water intake motors and pumps for water inflow through hull inlets and accelerated nozzle outflow of the propulsion jets above the hull waterline. Heretofore commercial ships with such water jet propulsors utilized jet deflecting buckets, sleeves and vanes for effective steering and backing purposes, involving above water jet discharge.

According to U.S. Pat. No. 6,171,159 issued January 2001 to Shen et al., surface ships propelled by underwater jet discharge are provided with steering and backing types of maneuvering systems, not suitable however for a submerged sea craft. It is therefore an important object of the present invention to provide for simplified and efficient controlled maneuvering of a submerged sea craft with water jet propulsors, involving steering, backing and stopping operations.

SUMMARY OF THE INVENTION

In accordance with the present invention, all maneuvering operations of an underwater jet propulsion system are performed by selectively controlled diversion of pressurized water through main water flow channels into secondary flow channels past flow smoothing vanes for controlled outflow discharge as the propulsion jets emerging from openings in the hull in one direction perpendicular to the hull centerline for steering purposes and in another direction at an acute negative thrust angle for backing and stopping purposes. Such directional outflow discharge jets are conducted to the hull openings from the secondary channels through subchannel branches under selective control of either closure gates at the hull openings or hinged juncture flow diverting flappers between the subchannels branches.

BRIEF DESCRIPTION OF THE DRAWING

A more complete appreciation of the invention and many of its attendant advantages will be readily appreciated as the same becomes better understood by reference to the following detailed description when considered in connection with the accompanying drawing wherein.

DETAILED DESCRIPTION OF THE PREFERRED EMBODIMENT

Figure 1:
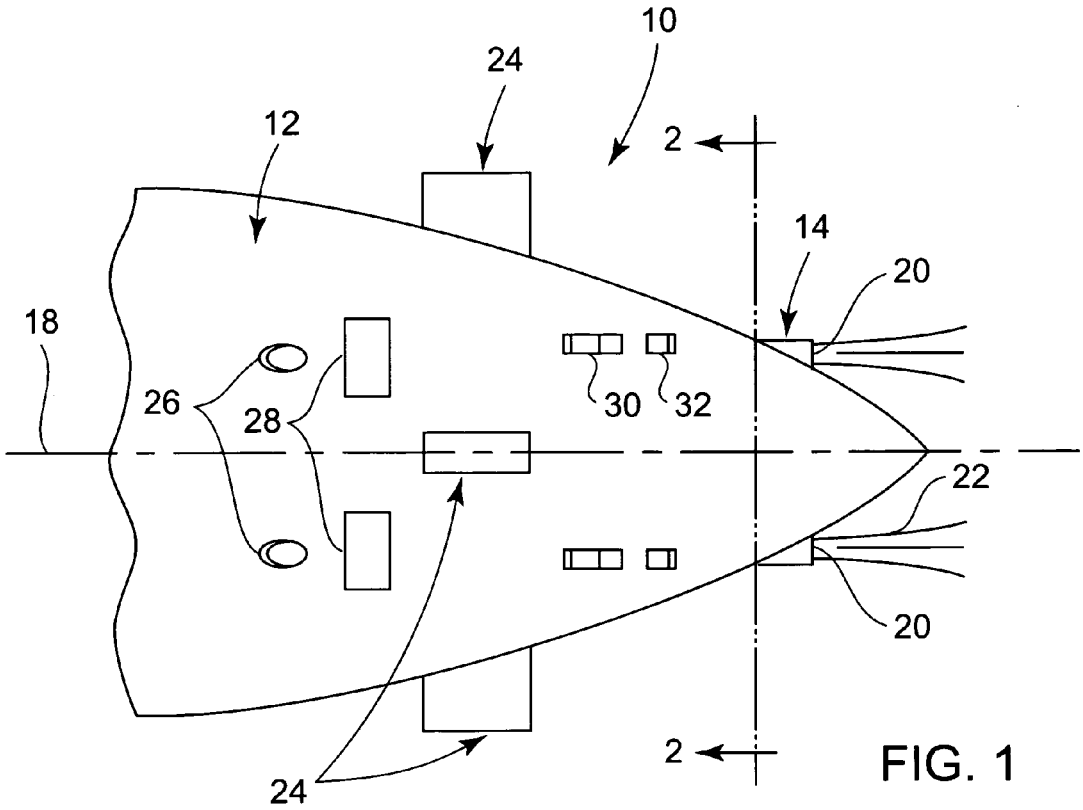
FIG. 1 is a partial side elevation view of the underwater stern portion of a sea craft hull with jet propulsion and maneuvering facilities positioned thereon.

Referring now to the drawing in detail, FIGS. 1–4 illustrate the stern portion of an underwater submerged ship or sea craft 10 having a generally conical-shaped hull 12 enclosing a ballast tank therein. The craft 10 is propelled in a forward direction by water jet propulsion on the stern portion of the hull 12 as generally known in the art, involving four (4) main tubular water outflow channels 14 extending from propulsors as disclosed for example in U.S. Pat. No. 6,171,159 to Shen et al. The channels 14 extend through the stern portion of the hull 12 in parallel spaced relation to the hull centerline 18. Stern outflow nozzles 20 at the ends of the channels 14 project from the hull 12 for emergence of propelling water jets 22 as shown in FIG. 1. Conventional rudders 24 are mounted on and project from the hull 12 between the main channels 14, spaced forwardly of the nozzles 20 along the hull centerline 18.

The foregoing referred to jet propulsion system for the sea craft 10, with which the four main water outflow channels 14 are associated, includes water inlets 26 on the hull 12 located adjacent to motor driven pump units 28 as shown in FIG. 1 for pressurizing water received within the channels 14 so as to emerge from the stern nozzles 20 as the propulsion jets 22. A pair of outflow gates 30 and 32 are formed in the hull 12 in alignment with each of the main channels 14, pursuant to the present invention as hereinafter explained.

Figure 2:
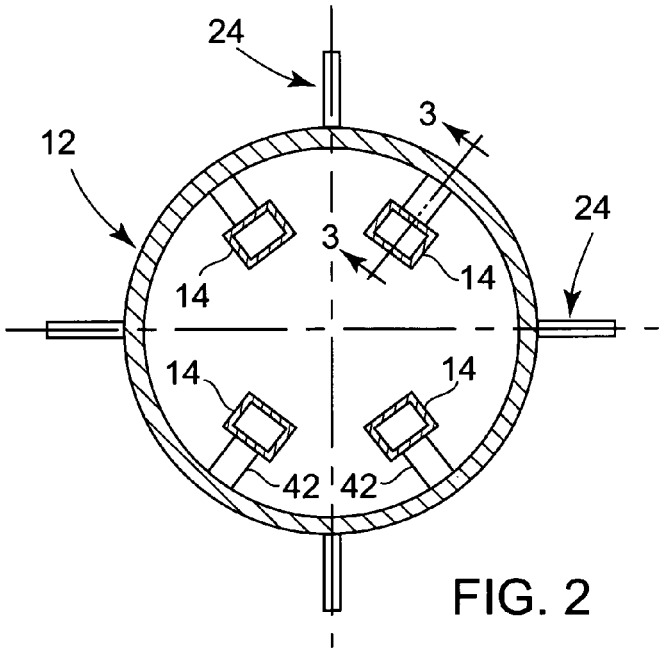
FIG. 2 is a section view taken substantially through a plane indicated by section line 2—2 in FIG. 1.
Figure 3:
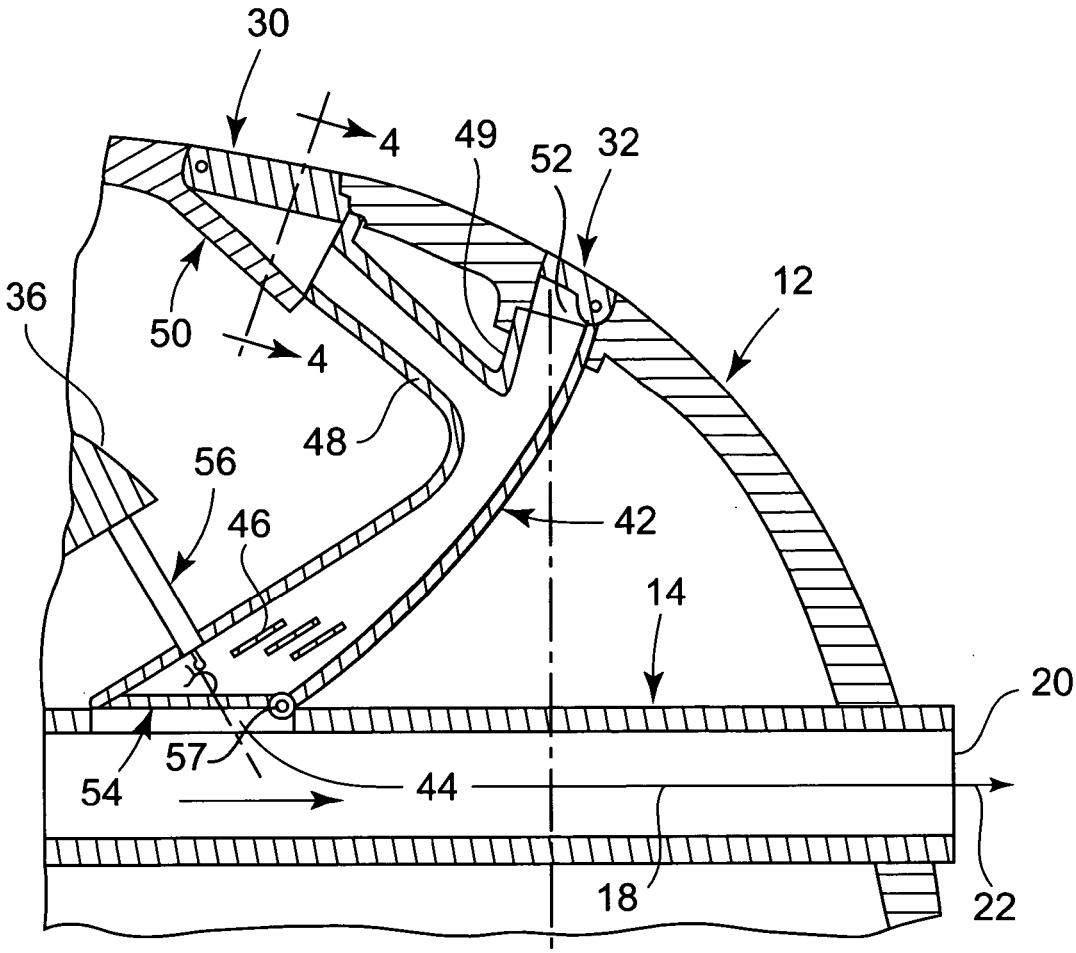
FIG. 3 is a partial section view taken substantially through a plane indicated by section line 3—3 in FIG. 2, illustrating craft maneuvering control facilities enclosed within the sea craft hull.
Figure 4:
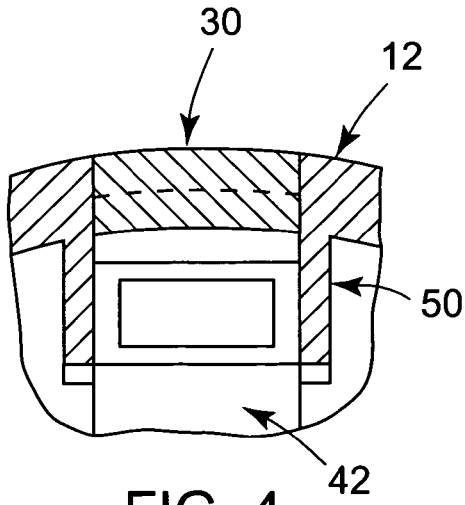
FIG. 4 is a partial section view taken substantially through a plane indicated by section line 4—4 in FIG. 3.

Referring now to FIGS. 2–4, positioned within the stern portion of the hull 12 between each of the four main flow channels 14 and an associated pair of the gates 30 and 32 aligned therewith is a secondary flow channel 42 which is connected to the main channel 14 at an opening 44 formed therein. Positioned within a streamlined convergent inlet section of the secondary flow channel 42 adjacent the opening 44 are guide vanes 46 for smoothing water inflow. An angularly related subchannel branch 48 extends from the secondary flow channel 42 into a sidewall outlet 50 projecting inwardly from the hull 12 at an acute angle to the centerline 18 as shown in FIG. 3. The gate 30 is hinged to the hull 12 within the outlet 50, while the other gate 32 is hinged to the hull 12 at a sidewall outlet 52 into which a subchannel branch 49 extends from the secondary channel 42. Also hinged to the main channel 14 at the opening 44 therein is a flap 54 pivotally connected to an actuator 56.

As also shown in FIG. 3, pressurized water flow is confined to each of the main channels 14 when the openings 44 associated therewith are closed by the flaps 54 for emergence of the water propelling jets 22 from the nozzles 20. With both of the gates 30 and 32 closed, straight course normal propulsion of the hull 12 is effected by the jets 22 in the direction of the centerline 18 without any hydrodynamic impact.

Figure 3A:
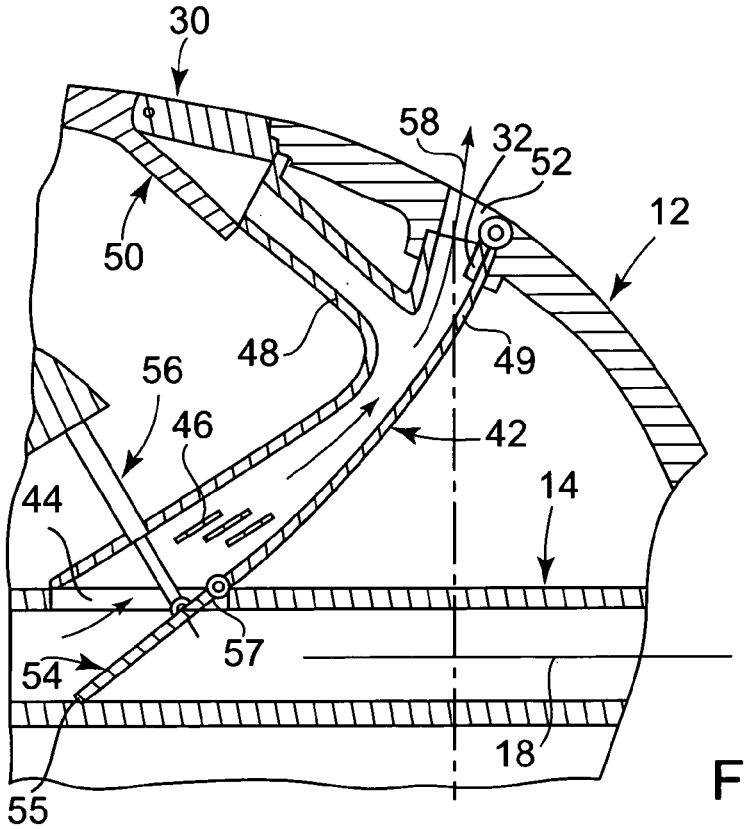
FIGS. 3A, 3B and 3C are partial section views similar to that of FIG. 3, showing different phased operational conditions of the maneuvering control facilities.

Under zero or low speed conditions the gate 32 is rotated about its hinge 55 into the hull 12 to open the outlet 52 as shown in FIG. 3A, while the flap 54 is displaced about its hinge 57 to a position fully blocking exit outflow from the end nozzle 20. Flow is then diverted by the flap 54 from the main channel 14 into the secondary flow channel 42 through the opening 44. Exit jet flow from the hull 12 then occurs through the secondary channel 42 and the branch 49 past the opened gate 32 for emergence from the outlet 52 as a jet 58 in a direction perpendicular to the centerline 18 to produce side force and turning moment on the hull 12 for ship steering purposes. The guide vanes 46 smooth such flow from the main channel 14 into the secondary channel 42. The differential pressure on the gate 32 is small, so that the force required to open and close the gate 32 is small. Since the exit jet vector 58 associated with outflow past the opened gate 32 is perpendicular to the ship centerline 18 as indicated in FIG. 3A, a large steering moment arm is obtained for efficient ship steering and docking.

Figure 3B:
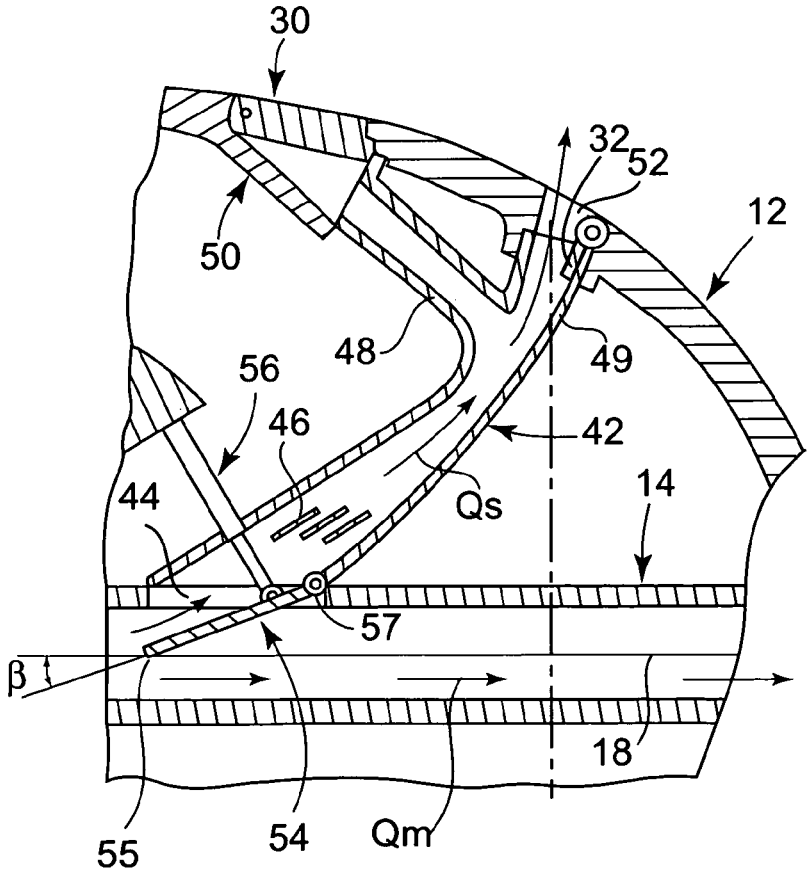

As shown in FIG. 3B, the flap 54 is rotated into the main channel 14 to a position at an angle β between the channel side wall and the flap 54 so as to divert only a portion of the main channel flow into the secondary channel 42 during travel at forward speeds. A diverted flow portion $Q_s$ in the secondary channel 42 then exits therefrom past the opened gate 32 for steering purposes. The flow portion $Q_m$ continuing through the main channel 14 past the flap 54 will then exit the nozzle end 20 for forward motion propulsion of the hull 12. The leading edge 55 of the flap 54 is rounded so as to improve hydrodynamic performance. There is a relationship between channel branch flows $Q_s$ and total main channel flow $Q_t$ denoted as $Q_s=Q_t-Q_m$, where the flap angle β and the flow portion $Q_m$ may be varied to provide the desired design speed and steering capability.

Figure 3C:
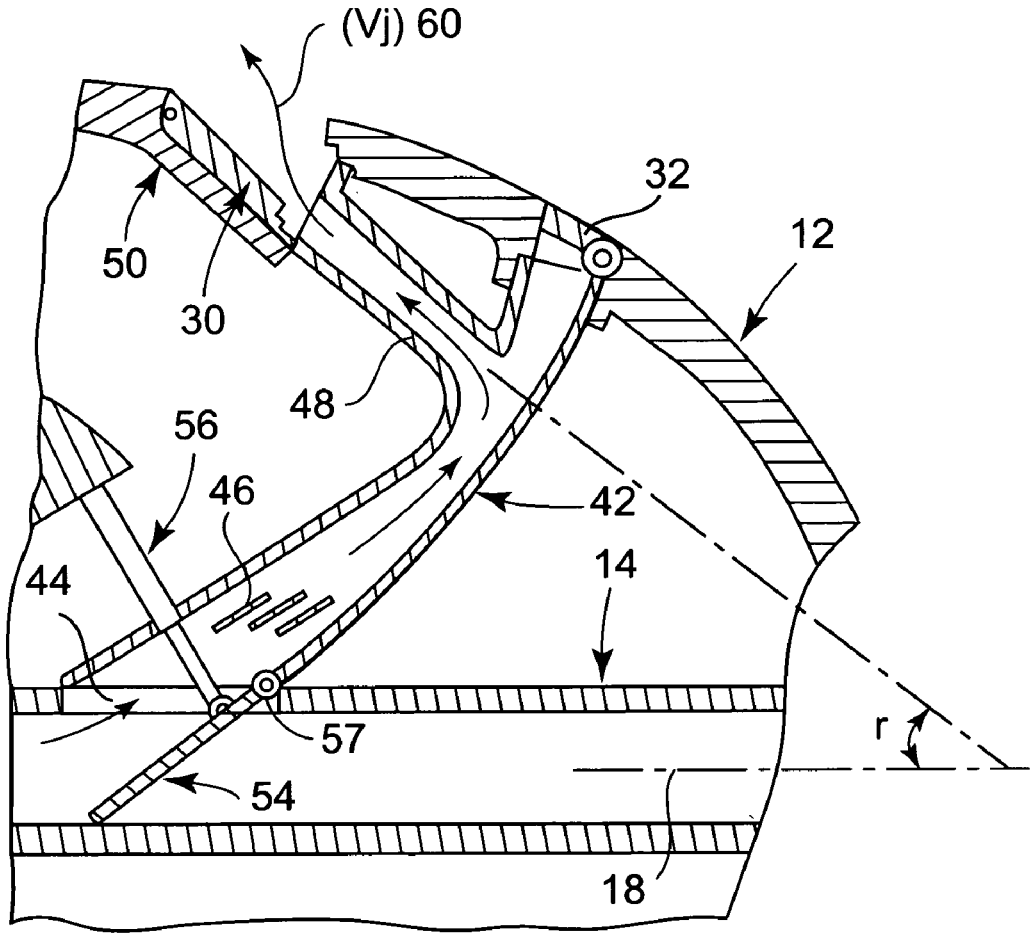

Referring now to FIG. 3C, it denotes an acute angle γ between flow through the subchannel branch 48 and the hull centerline 18, corresponding to that of a negative backing thrust (F) induced by an outflow jet 60 from the outlet 50 at a jet velocity ($V_j$) past the gate 30 opened by inward displacement into the hull 12 for backing and stopping purposes under low speed conditions. Negative thrust (F) for backing purposes, is reflected by the equations $F=\rho QV_j\text{Cos}\gamma=\rho Q^2A_j\text{Cos}\gamma$. Maneuvering control is exercised in accordance with the foregoing relationships between flow, speed and thrust, as well as water density (ρ), flow rate (Q), jet velocity ($V_j$) and flow area ($A_j$) of the outlet 52 at the exit gate 32.

Figure 5:
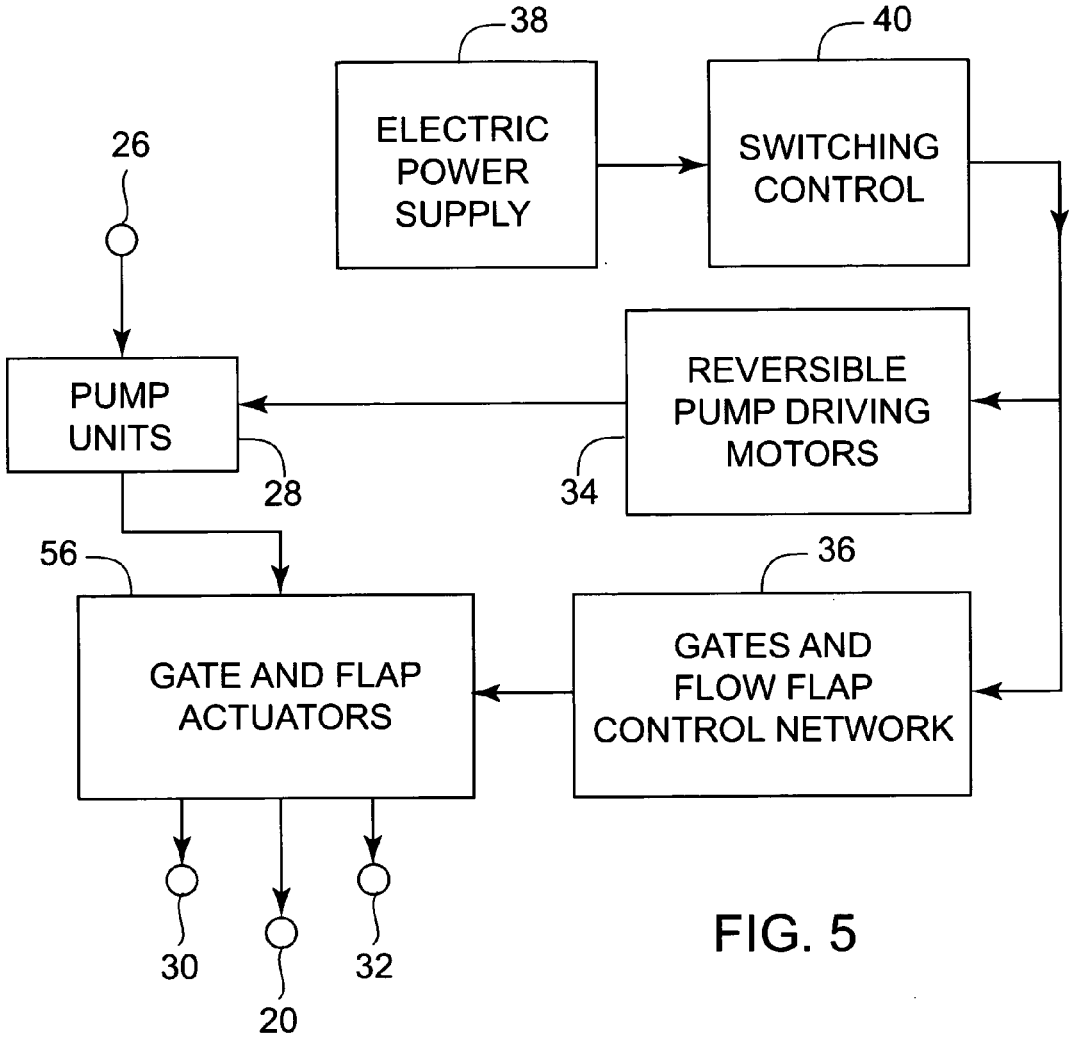
FIG. 5 is a diagram illustrating a water jet propulsion and maneuvering control system associated with the sea craft shown in FIGS. 1–4, in accordance with the present invention.

As diagrammed in FIG. 5, the pump units 28 are driven by reversible motors 34 while the gates 30 and 32 as well as sidewall flaps as hereinafter described are displaced under control of a maneuvering control network 36. Operation of the pump motors 34 and the control network 36 for maneuvering of the craft 10 as hereinbefore explained is effected by an electric power supply 38 through a switching control system 40 of the propulsion system.

Figure 6:
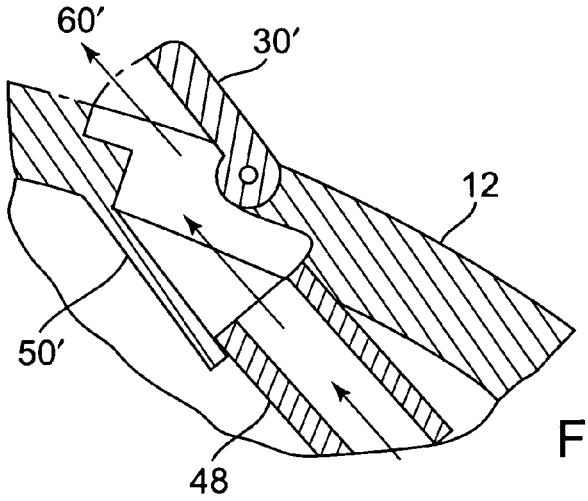
FIG. 6 is a partial section view corresponding to that of FIG. 3, showing an alternative embodiment of the present invention.

Referring now to FIG. 6, a modification of the embodiment illustrated in FIGS. 1–5 is shown, wherein the gate 30 is replaced by a gate 30' hinged to the hull 12 radially outward of an inclined sidewall outlet 50' opened by rotation of the gate 30' outwardly from the hull 12. The advantage of such location gate 30' is that it may be angularly adjusted to directionally regulate the outflow of a jet 60' for backing and stopping purposes.

Figure 7:
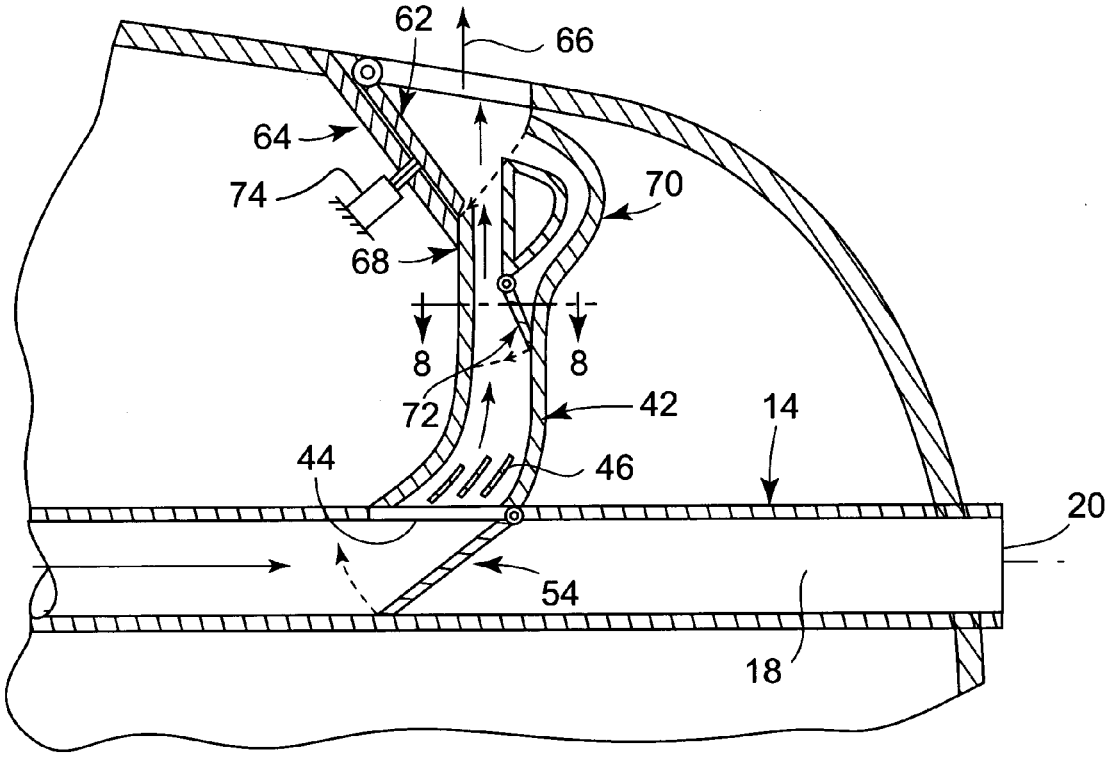
FIG. 7 is a partial section view corresponding to that of FIG. 3, showing yet another alternative embodiment of the present invention.
Figure 8:
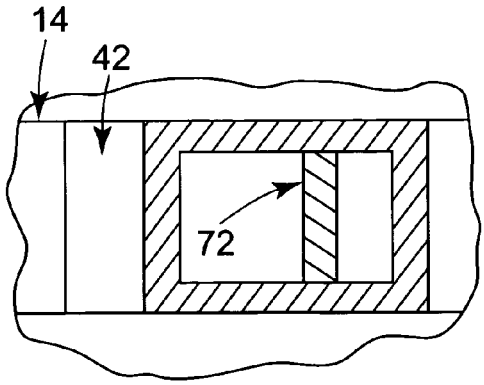
FIG. 8 is a partial section view taken substantially through a plane indicated by section line 8—8 in FIG. 7.

According to the embodiments of the present invention as hereinbefore described, the pair of gates 30 and 32 or 30' and 32 are provided on the surface of the hull 12 for use in association with each of the four main flow channels 14. According to yet another embodiment as illustrated in FIGS. 7 and 8 only one gate 62, larger than the gates 30, 30' and 32, is provided on the stern portion surface of the hull 12 for use with each main flow channel 14. The gate 62 is directly hinged to the hull 12 on top of an outlet 64 through which an exit jet 66 emerges in a direction perpendicular to the hull centerline 18 for steering maneuver purposes. The secondary channel 42 with the guide vanes 46 therein is provided at the opening 44 in the main flow channel 14; with the side wall flap 54 hinged for angular displacement between positions as hereinbefore described. However pursuant to the embodiment shown in FIG. 7, two outflow subchannels branches 68 and 70 are connected to the secondary channel 42, with a flapper 72 hinged at a juncture between the subchannel branches 68 and 70 to directionally control flow into one of the subchannel branches 68 and 70 to the hull opening outlet 64. The flap 54 is rotated to the fully closed position while the gate 64 is rotated to a fully closed position by an actuator 74 for normal operation.

Figure 7A:
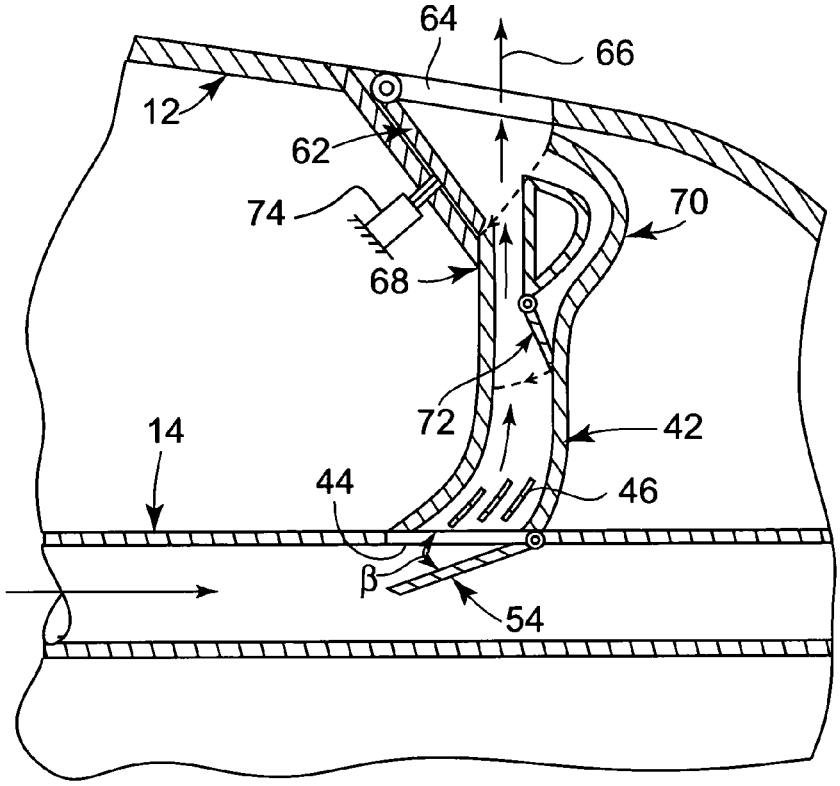
FIGS. 7A and 7B are partial section views similar to that of FIG. 7, showing different phased operational conditions of the maneuvering control facilities.

When steering is needed under a zero or low speed condition, such as a docketing maneuver, the gate 62 is in the fully opened position for outflow of the exit jet 66 from both of the subchannel branches 68 and 70, with the flapper 72 positioned between the subchannel branches 68 and 70. With the flapper 72 closing the subchannel branch 70 as shown in FIG. 7A, flow is then diverted only through the subchannel branch 68 in a direction perpendicular to the hull centerline 18 to thereby effect outflow of the steering control jet 66 from the hull opening outlet 64 during forward speed of travel, with the control flap 54 rotated to the acute angle (β) position shown to only direct a portion of flow through the main channel 14 into the secondary channel 42.

Figure 7B:
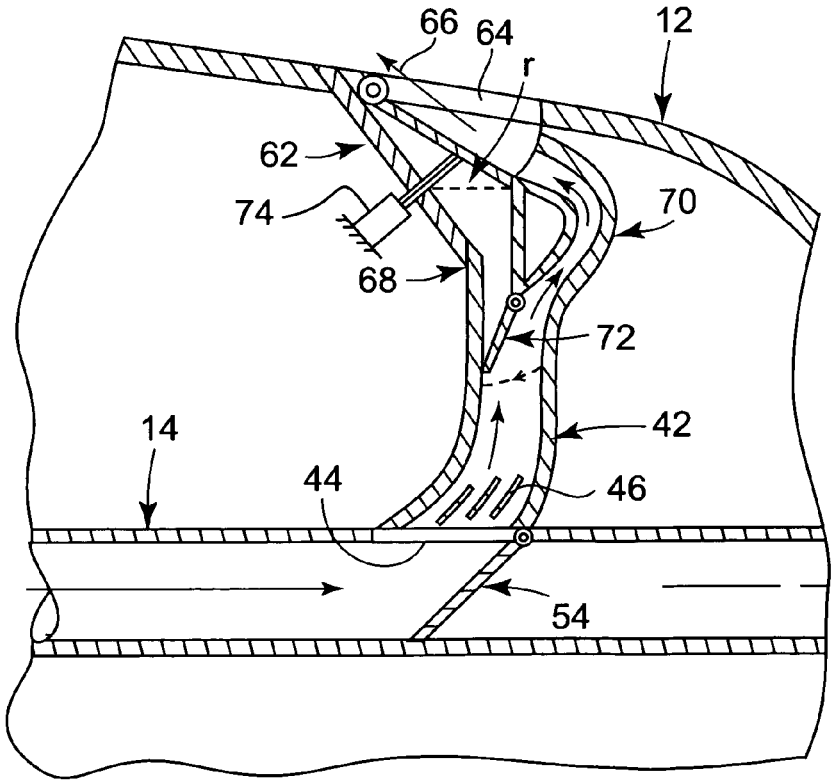

For backing and stopping purposes the flapper 72 is rotated to the position shown in FIG. 7B totally diverting flow from the secondary channel 42 into the curved subchannel branch 70. Outflow of the jet 66 is then directed from the branch 70 through the hull opening outlet 64 at an angle γ, while flow to the nozzle 20 is blocked by the flap 54.

Obviously, other modifications and variations of the present invention may be possible in light of the foregoing teachings. It is therefore to be understood that within the scope of the appended claims the invention may be practiced otherwise than as specifically described.

What is claimed is:

1. In combination with a submerged sea craft having a hull through which main flow channels extend between water inlet openings in the hull and propulsion jet nozzles projecting from outlets in the hull in parallel spaced relation to a centerline of the hull, maneuvering control flow means enclosed within the hull, comprising: a secondary flow channel connected to each of the main flow channels in spaced relation to the jet nozzles, two subchannel branches extending from each of the secondary flow channels in different directions to the outlets in the hull; and controllable flow diversion means for selectively diverting flow of pressurized water from the main flow channel into the secondary flow channel to undergo outflow as jets through the subchannel branches from the hull in said different directions from the outlets in the hull.

2. The combination as defined in claim 1, wherein said flow diversion means includes: a sidewall flap hingedly mounted on the main flow channel at an outflow opening into the secondary channel; and actuator means connected to the flap for rotation thereof between a closure position closing the outflow opening and a flow diverting position within the main flow channel at an acute angle to said outflow opening.

3. The combination as defined in claim 2, wherein said flow diversion means further includes: gate means hingedly mounted on the hull for selectively blocking said outflow of the jets through the subchannel branches from the hull in said different directions.

4. The combination as defined in claim 3, wherein one of said different directions is perpendicular to the hull centerline, whereby said outflow of the jets from the hull controls steering; and the other of the different directions is at an acute negative thrust angle to the hull centerline, whereby said outflow of the jets from the hull controls backing and stopping.

5. The combination as defined in claim 1, wherein said flow diversion means includes: gate means hingedly mounted on the hull for selectively blocking said outflow of the jets through the subchannel branches from the hull in said different directions.

6. The combination as defined in claim 1, wherein one of said different directions is perpendicular to the hull centerline, whereby said outflow of the jets from the hull controls steering; and the other of the different directions is at an acute negative thrust angle to the hull centerline, whereby said outflow of the jets from the hull controls backing and stopping.

7. The combination as defined in claim 1, wherein said flow diversion means includes: flapper means hingedly mounted at a juncture between the two subchannel branches for displacement between positions respectively blocking inflow into one of the subchannels branches.

8. The combination as defined in claim 7, wherein said flow diversion means further includes: gate means hingedly mounted on the hull for selectively blocking said outflow of the jets through the subchannel branches from the hull.

9. In combination with a hull of an underwater sea craft through which pressurized water flow is conducted in one direction through main flow channels to nozzles from which forward propulsion jets emerge; maneuver controlling flow means associated with said main flow channels for discharge of steering and backing jets from outlet openings in the hull in different directions relative to said one direction of flow through the main flow channels; said maneuver controlling flow means comprising: a secondary flow channel connected to each of the main flow channels in rearwardly spaced relation to the nozzles; a pair of subchannel branches extending from each of the secondary flow channels to said outlet openings in the hull; flap means mounted on each of the main flow channels for displacement between positions alternatively blocking flow of the pressurized water to the secondary flow channels and to the nozzles or dividing said flow of the pressurized water between the secondary flow channels and the nozzles; and gate means selectively displaced between positions blocking said discharge from all of the outlet openings in the hull or permitting either one of said discharge of the steering and backing jets from the outlet openings in the hull associated therewith.

10. The combination as defined in claim 9, wherein said gate means associated with each of the main flow channels comprises: steering and backing closure gate elements pivotally mounted on the hull at each of a pair of the outlet openings therein associated with each of the main flow channels.

11. The combination as defined in claim 9, wherein said gate means associated with each of the main flow channels comprises: a gate element pivotally mounted on the hull at each of the openings therein and displaceable to three positions respectively blocking outflow of the discharge from the outlet openings and alternatively blocking outflow of either the steering or the backing discharge through the outlet openings from one of the pair of the subchannel branches; and flapper means mounted in the secondary flow channel for alternatively blocking flow from the secondary flow channel into one of the pair of the subchannel branches.

* * * * *